US006513290B2

(12) United States Patent
Leek

(10) Patent No.: US 6,513,290 B2
(45) Date of Patent: Feb. 4, 2003

(54) CONCENTRIC HOLDOWN

(75) Inventor: William F. Leek, Carmel, CA (US)

(73) Assignee: Simpson Strong-Tie Company, Inc., Dublin, CA (US)

( * ) Notice: Subject to any disclaimer, the term of this patent is extended or adjusted under 35 U.S.C. 154(b) by 0 days.

(21) Appl. No.: 09/729,604

(22) Filed: Dec. 3, 2000

(65) Prior Publication Data

US 2002/0066247 A1 Jun. 6, 2002

(51) Int. Cl.[7] ..... E04B 1/38; E04H 12/22; E02D 27/42

(52) U.S. Cl. ..... 52/295; 52/297; 52/298; 52/704; 52/708; 52/712; 52/713; 403/232.1

(58) Field of Search ..... 52/294, 295, 296, 52/297, 298, 293.3, 702, 704, 706, 708, 712, 713

(56) References Cited

U.S. PATENT DOCUMENTS

| | | | |
|---|---|---|---|
| 967,107 | A | 8/1910 | Cook et al. |
| 1,335,617 | A | 3/1920 | Solomon |
| 1,503,148 | A | 7/1924 | Bernstrom |
| 1,696,288 | A | 12/1928 | Underwood |
| 2,227,713 | A | 1/1941 | Higgins |

(List continued on next page.)

FOREIGN PATENT DOCUMENTS

| | | | |
|---|---|---|---|
| DE | 1205686 | * 11/1965 | ..... 52/298 |
| DE | 9312522 | 12/1993 | |

OTHER PUBLICATIONS

Simpson Strong–Tie Co., Inc., "Wood Construction Connectors," Catalog C–2000, Simpson Strong–Tie Co., Inc. (USA), p. 31–36, (Aug. 24, 1999).

ICBO Evaluation Service, Inc., "USP Lumber Connectors PHD and UPHD Series Hold–downs," Evaluation Service Report ER–5830, ICBO Evaluation Service, Inc. (US), pp. 1–3, (Sep. 1, 2000).

U.S. patent application No. 09/384, 512, filed Aug. 27, 1999.

U.S. patent application No. 08/975,940, filed Nov. 21, 1997.

Author Unknown, "The Hardy Frame," The Hardy Frame, Publisher Unknown (US), pp. 1–4, (received in 1997).

ICBO Evaluation Service, "Hardy Frame, Hardy Frame Heavy Duty, 18–inch Hardy Braced Frame and Hardy Frame Screw," Evaluation Report, ICBO Evaluation Service (US), pp. 1–11, (Sep. 1, 1999).

Simplified Strucural Systems, "Makers of the HardyFrame," Simplified Structural Systems, Simplified Structural Systems (US), pp. 1–4, (received in 2000).

Simplified Structural Systems, "Descriptions and Typical Installation Details," The Hardy Frame, Simplified Structural Systems (US), pp. H–1–H4, (received in 2000).

Simplified Structural Systems, "Recommendation for the 18 Hardy Frames," Recommendation for the 18"to Hardy Frames, Simplified Structural Systems (US), pp. 1–3, (received in 2000).

*Primary Examiner*—Laura A. Callo
*Assistant Examiner*—Brian E. Glessner
(74) *Attorney, Agent, or Firm*—Charles R. Cypher; James R. Cypher

(57) ABSTRACT

A connector for attaching a first building structural member to a second building structural member in conjunction with fasteners and an anchor member to resist forces on buildings imposed by earthquakes, hurricanes, tornadoes and other similar cataclysmic forces is made with a strap and a standoff base. The standoff base receives the anchor member, and bears upon the strap. The strap is connected to the first building structural member by means of the fasteners. The first building structural member bears upon the standoff base while being lifted above the anchor member by the standoff base.

16 Claims, 7 Drawing Sheets

U.S. PATENT DOCUMENTS

| | | | | | |
|---|---|---|---|---|---|
| 3,413,773 | A | | 12/1968 | Fitzgerald | |
| 4,096,677 | A | | 6/1978 | Gilb | |
| 4,199,908 | A | * | 4/1980 | Teeters | 52/295 |
| 4,367,864 | A | | 1/1983 | Eldeen | |
| 4,387,543 | A | | 6/1983 | Tschan et al. | |
| 4,480,941 | A | | 11/1984 | Gilb et al. | |
| 4,530,194 | A | | 7/1985 | Linton et al. | |
| 4,587,788 | A | | 5/1986 | Bielicki | |
| 4,603,531 | A | | 8/1986 | Nash | |
| 4,614,070 | A | | 9/1986 | Idland | |
| 4,869,467 | A | | 9/1989 | Kellison | |
| 4,875,314 | A | | 10/1989 | Boilen | |
| 4,924,648 | A | | 5/1990 | Gilb et al. | |
| 4,995,206 | A | | 2/1991 | Colonias et al. | |
| 5,092,097 | A | * | 3/1992 | Young | 52/702 |
| 5,212,919 | A | | 5/1993 | Shaw et al. | |
| 5,301,485 | A | | 4/1994 | Shaw et al. | |
| 5,307,603 | A | | 5/1994 | Chiodo | |
| 5,333,435 | A | | 8/1994 | Leek | |
| 5,375,384 | A | | 12/1994 | Wolfson | |
| 5,384,993 | A | | 1/1995 | Phillips | |
| 5,467,569 | A | | 11/1995 | Chiodo | |
| 5,501,048 | A | | 3/1996 | Nakanishi | |
| 5,531,054 | A | | 7/1996 | Ramirez | |
| 5,535,561 | A | | 7/1996 | Schuyler | |
| 5,540,530 | A | | 7/1996 | Fazekas | |
| 5,570,549 | A | | 11/1996 | Lung et al. | |
| 5,575,130 | A | | 11/1996 | Chiodo | |
| 5,666,774 | A | | 9/1997 | Commins | |
| 5,706,626 | A | | 1/1998 | Mueller | |
| D399,013 | S | | 9/1998 | Nguyen | |
| 5,979,130 | A | | 11/1999 | Gregg et al. | |
| 5,987,828 | A | | 11/1999 | Hardy | |
| 6,015,138 | A | | 1/2000 | Kohlberger et al. | |
| 6,067,769 | A | | 5/2000 | Hardy | |
| 6,112,495 | A | | 9/2000 | Gregg et al. | |
| 6,141,928 | A | | 11/2000 | Platt | |

* cited by examiner

CONCENTRIC HOLDOWN

BACKGROUND

This invention relates to a connector for anchoring a first building structural member to a second building structural member. The connector works in conjunction with a separate anchor member that is received by or is attached to the second building structural member and with fasteners for attaching the connector to the first building structural member.

Earthquakes, hurricanes, tornadoes, and floods impose forces on a building that can cause structural failure. To counteract these forces, it has become common practice to strengthen or add ties between the structural members of a building in the areas of the building where these cataclysmic forces may be concentrated. For example: framed walls can be attached to the foundation rather than merely rest on it; connections between the framed walls of each floor can be strengthened; and joists can be connected to both their headers and the walls that support the headers. One of the most common connectors designed for this application is called a holdown by the inventor. Holdowns are commonly used to anchor framed walls to the foundation.

Early holdowns were constructed from two or more separate pieces of metal welded together. These holdowns had to be painted to prevent rusting. They were heavy and costly to produce.

State of the art holdowns are made from galvanized sheet metal formed on progressive die machines that require no welding or painting. See U.S. Pat. No. 4,665,672, granted May 19, 1987, to Commins, Gilb and Littleton; U.S. Pat. No. 5,092,097 granted Mar. 3, 1992, to Young; and U.S. Pat. No. 5,249,404, granted Oct. 5, 1993, to Leek and Commins. These advancements have reduced the cost of making holdowns while increasing their ability to withstand tension forces. However, severe earthquakes in San Francisco, Los Angeles, and Kobe, Japan, demonstrate that holdowns capable of being mass produced and installed inexpensively should be made even stronger for many connections.

Typical holdowns work in conjunction with a separate anchor member—and attach to the side face of the first building structural member generally a vertically disposed stud in vertical applications in walls. In these holdowns that attach to the side of a stud or post, the anchor member attaches at the seat of the connector. This seat is connected to a back member, and the back member attaches to the side face of the stud or post. Often, these holdowns have one or more side members 9 to increase the strength of the connector or to connect the seat member to the back member.

Another style of holdown attaches to the bottom end of the stud or post. A patented example of this type of holdown is found in U.S. Pat. No. 5,375,384, granted to Yehuda Wolfson on Dec. 27, 1994. The advantage of a holdown that attaches to the bottom end of a post or stud is that it can remove any eccentricity from the connection. The holdown of the present invention is this type of holdown.

The holdown connector of the present invention improves upon the prior art by providing a holdown that withstands very high tension loads with minimal deflection, while being economical to produce.

SUMMARY OF THE INVENTION

The present invention is a connection between a first building structural member and a second building structural member using a connector, an anchor member and fasteners.

The anchor member is held by the second building structural member. The anchor member has a first end which protrudes above the second building structural member. A connector receives the first end of the anchor member. The connector consists of a channel-shaped strap and a standoff base. The strap has a base and two side members 9. The base of the strap is formed with an opening for receiving the anchor member there through. The separate standoff base, which is received between the side members 9 of the strap and rests on said base of the strap, is formed with an opening for receiving the anchor member. The standoff base is connected to the anchor member. A first building structural member is received between the side members 9 of the strap. This member rests on and is supported by the top of the standoff base which lifts the bottom of the first structural building member above the first end of said anchor member. Fasteners complete the connection by connecting the side members 9 of the strap to the first building structural member.

The object of the present invention is to provide a connector that better withstands tension forces than the prior art, while still being economical to produce and simple to install.

The connector of the present invention has been tested, and found to have very high design loads. An embodiment of the connector of the present invention which is formed to anchor a 4×4 post or two sistered 2×4 studs and uses 24 2.5" Simpson Strong-Drive wood screws has been found to have a design load of 9735 pounds. This design load is based on a static load tests conducted on a steel jig, using wood posts. The design load is the lowest of three different possible measures of the strength of the connection: the value at which the holdown deflects 0.125", the deflection being measured as the movement in the connection due to movement of the connector between the anchor bolt and the strap portion of the holdown; the load at which failure of the connection occurs—ultimate load—divided by 3, or the calculated values for 24 wood screws loaded in shear and connecting a wood member to a 10 gauge steel strap.

A further object of the present invention is to provide a base for the first building structural member that resists design compression loads. The preferred base is formed from cast aluminum, making it very strong.

A further object of the present invention is to provide a connector that does not create any eccentric loading. This is accomplished by setting the post that is anchored by the connector directly over the point where the connector attaches to the bolt or anchor member.

A further object of the present invention is to provide a connector that accommodates variations in the position of the anchor member parallel to the face of the first building structural member to which the holdown connector attaches. This object is achieved by forming the connector with a relatively wide opening for receiving the anchor member.

The object of making a holdown that is economical to produce is achieved by utilizing a design that can be formed on automated machinery with a minimum of costly secondary operations, such as painting and welding.

These and other objects of the present invention will become apparent, with reference to the drawings, the description of the preferred embodiment and the claims.

DESCRIPTION OF THE PREFERRED EMBODIMENT

Figure 1:
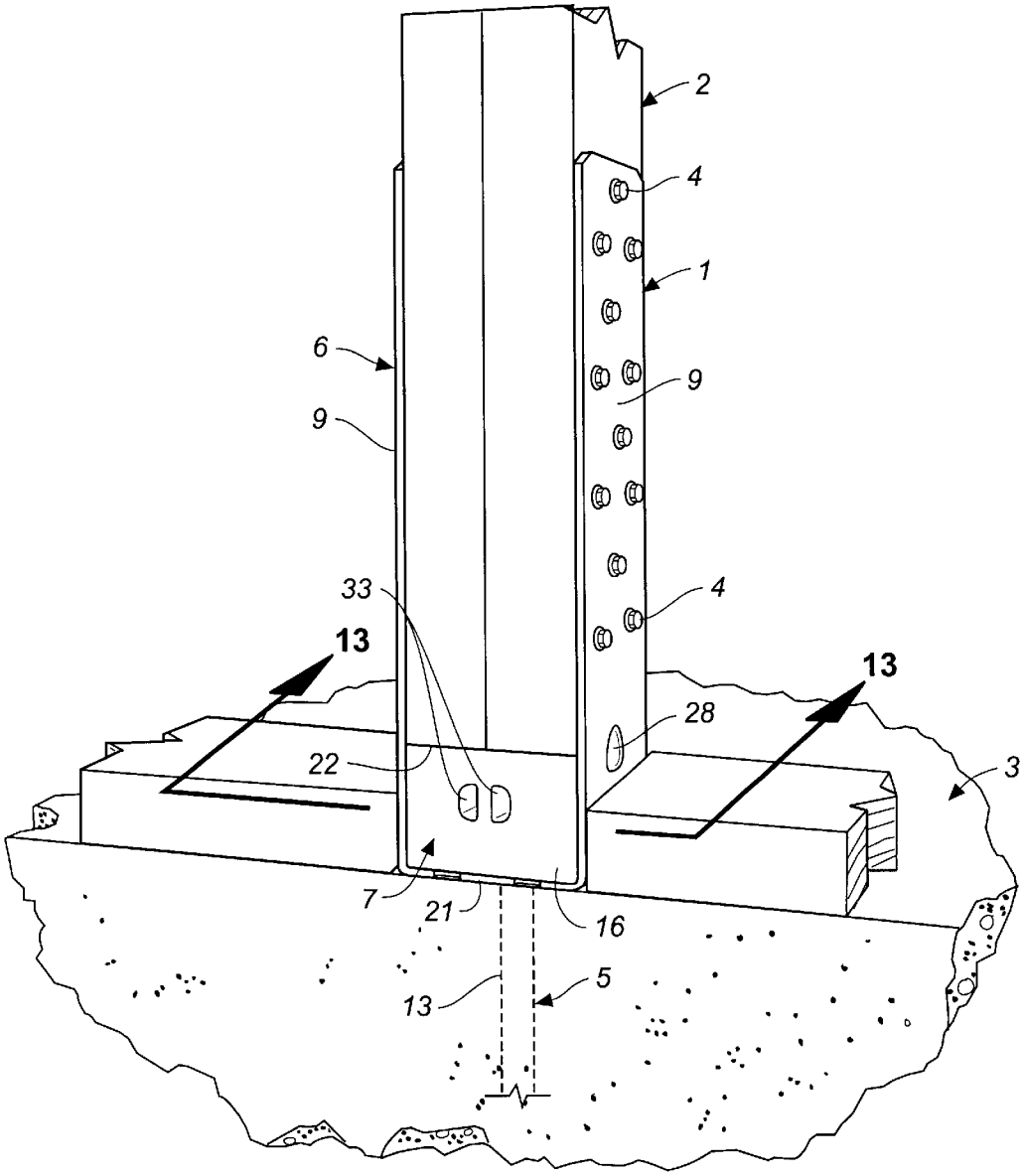
FIG. 1 is a perspective view of a vertical member in a building structure. The post is anchored by the holdown connector of the present invention in conjunction with threaded fasteners and an anchor member.
Figure 2:
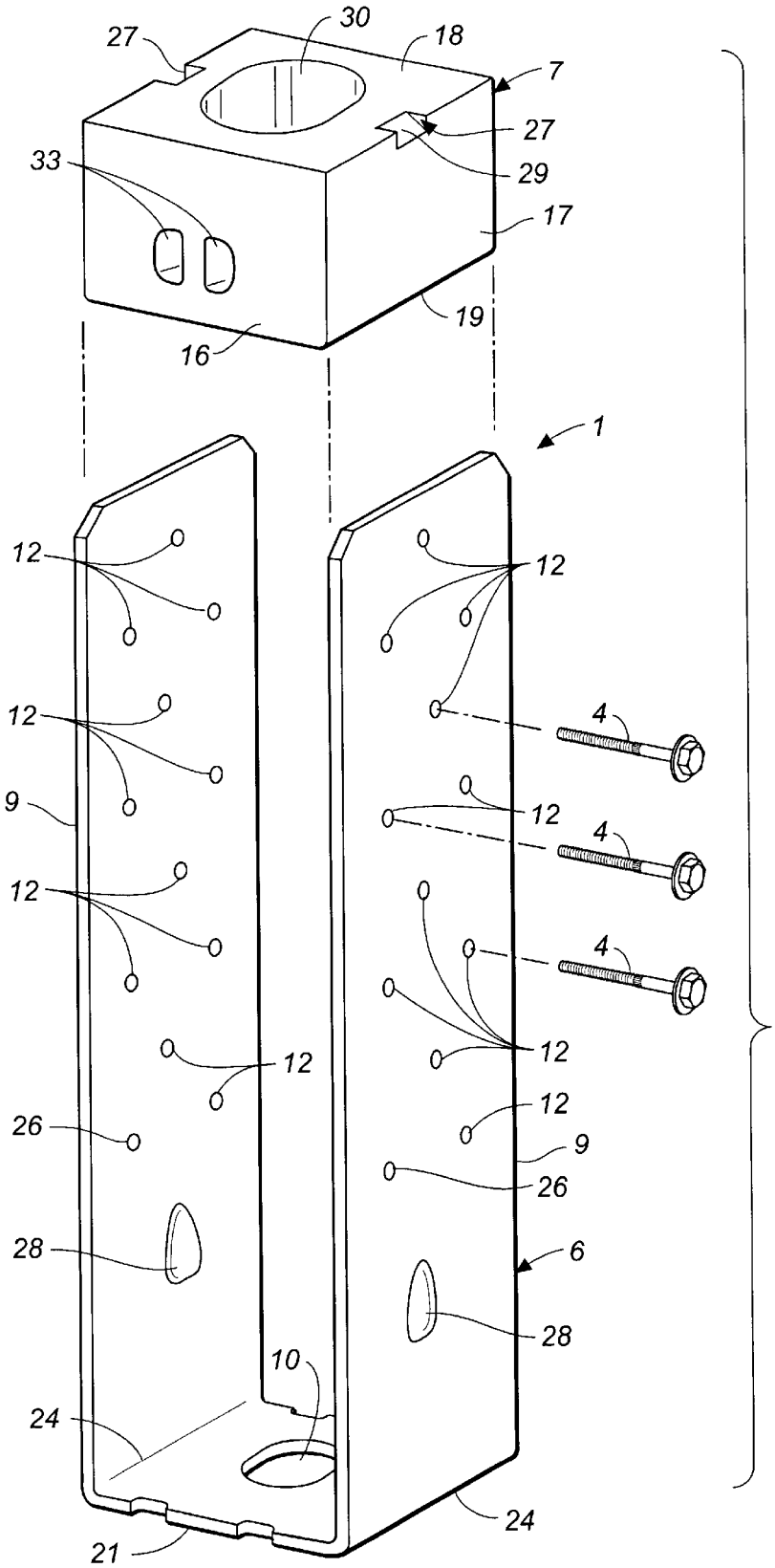
FIG. 2 is an exploded perspective view of a connector constructed in accordance with the present invention. Examples of the preferred threaded fasteners for making the connection between the first building structural member and connector are shown as well.
Figure 3:
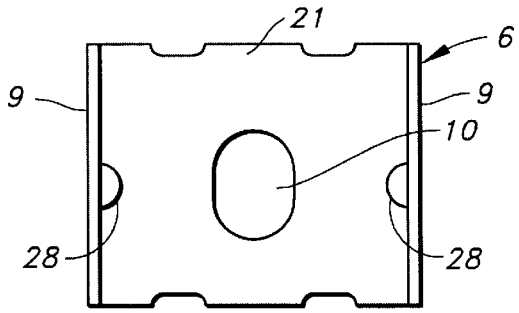
FIG. 3 is a top plan view of the strap of the connector of FIG. 1.

As seen in FIGS. 1 and 2, a connector 1 for tying a first building structural member 2 to a second building structural member 3 in conjunction with fasteners 4 and an anchor member 5, constructed in accordance with the present invention, consists of a strap 6 which receives the fasteners 4 for attaching the strap 6 to the first building structural member 2, and a standoff base 7 which nests within the strap 6 and which receives the first end 8 of the anchor member 5 for attaching the connector 1 to the second building structural member 3.

The anchor member 5 is held by the second structural building member 3 and has a first end 8 protruding above the second structural building member 3.

The preferred connector 1 of the present invention is formed as a channel-shaped strap 6 having a base 21 and two side members 9. The base 21 of the strap 6 is formed with an opening 10 for receiving the anchor member 5 there through for attaching the connector 1 to the second building structural member 3.

The preferred standoff base 7 is a separate member from the channel-shaped strap 6. The preferred standoff base 7 is received between the side members 9 of the strap 6 and bears on the base 21 of the strap 6. The standoff base 7 is formed with an opening 11 for receiving the anchor member 5. The standoff base 7 is connected to the anchor member 5.

The first building structural member 2 which can be a vertically disposed wooden post 2 is also received between the side members 9 of the strap 6 and rests on and is supported by the top 18 of the standoff base 7. At the same time, the bottom 22 of the post 2 is disposed above the first end 8 of the anchor member 5.

Figure 5:
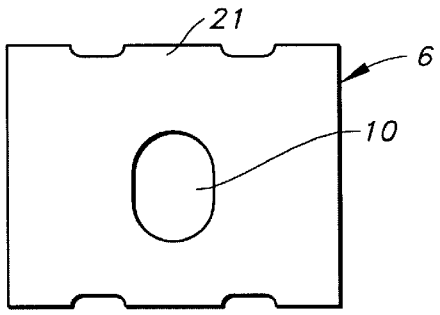
FIG. 5 is a bottom plan view of the strap of the connector of FIG. 1.
Figure 8:
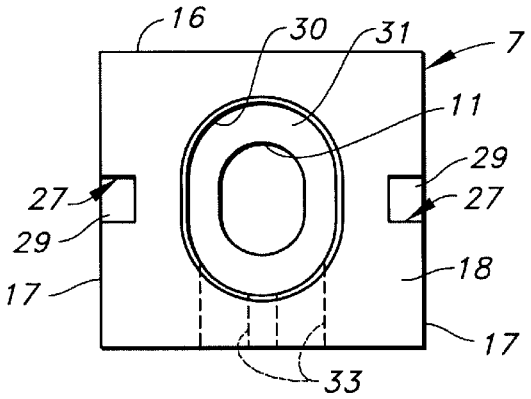
FIG. 8 is a top plan view of the standoff base of the connector of FIG. 1.

As is shown in FIGS. 5 and 8, the strap 6 and the standoff base 7 are preferably formed with obround openings 10 and 11 for receiving the anchor member 5. This provides the connector 1 with the ability to accommodate anchor members 5 that have not been attached to the second building structural member 3 in exactly the right place. Anchor members 5 are rather simple to place when the second building structural member 3 is a wooden component of a lower level of the building; however, once an anchor member 5 is set in a concrete foundation 3 it is very difficult to correct its placement.

Preferably, the strap 6 of the connector 1 is formed with openings 12 and 26 for receiving the fasteners 4.

Figure 13:
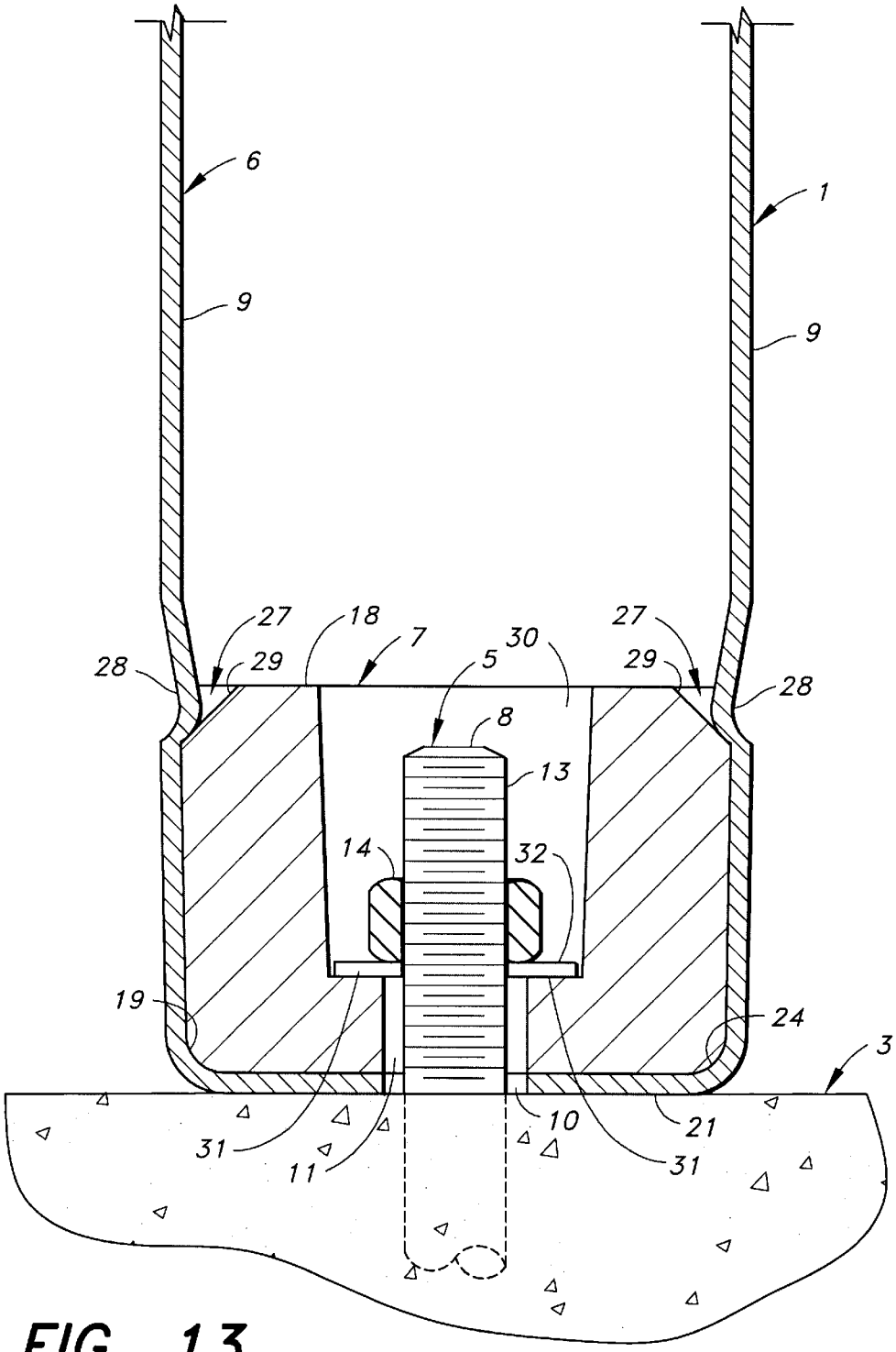
FIG. 13 is a cross-sectional side view taken along line 13—13 of FIG. 1. The vertical member is not shown in FIG. 13.

Referring to FIG. 13, the anchor member 5 can consist of an anchor bolt 13 and a holding member 14 attached thereto. When the second building structural member 3 is a concrete foundation 3, the bottom portion of the anchor bolt 13 is embedded in the second building structural member 3, as shown in FIG. 1. Preferably, the bottom end of the anchor bolt 13 is formed with a compound curve to provide pullout resistance. The top end 8 of the anchor bolt 13 can be formed with a threaded portion to which the holding member 14, generally a threaded nut 14, can releasably attach, completing the anchor member 5.

In the preferred embodiment, the standoff base 7 has a bottom face 15 four sides 16 and 17 and a top 18. Two of the four sides of the base 7 are labeled as the two opposing lateral sides 17. The bottom face 15 meets the two opposing lateral sides 17 at two lateral junctures 19. The bottom face 15 of the standoff base 7 is also formed with a bearing surface 20. The two opposing lateral sides 17 each have a selected height.

In the preferred embodiment, the base 21 and side members 9 of the strap 6 are formed to conform exactly to the shape of the bearing surface and to the shape of the standoff base 7 at the two lateral junctures 19. Also in the preferred embodiment, the side members 9 of the strap 6 are formed to conform exactly to the shape of the opposing lateral sides 17 of the standoff base 7 for substantially all of the height of the two opposing lateral sides 17.

In the preferred embodiment, the junctures 19 between the bottom face 15 and the two opposing lateral sides 17 are formed as continuous curves with relatively large radii 23. The radius 23 of this curve on each side is 0.250 inches.

In a similar fashion the base of the strap 21 meets the side members 9 at curved junctions 24. The radii 25 of these curved junctions 24 is also 0.250 inches. The other dimensions of the strap 6 are also selected to match the dimensions of the standoff base 7, such that the strap 6 receives the standoff base 7 almost exactly. This eliminates practically all deflection of the connector 1 at the design uplift loads.

Referring to FIG. 2, when the first building structural member 2 is made of wood, the fasteners 4 are preferably wood screws with cutting points. The fasteners 4 can also be nails, threaded bolts with nuts, lag screws, or steel screws to name a few variations. The use of self-drilling wood screws as fasteners 4 eliminates the need for the added step of drilling a hole for a regular bolt that has no drilling point. Self-drilling wood screws 4 create a stronger connection than nails, and self-drilling wood screws can be installed almost as quickly as nails if an electric-powered or pneumatic driver is used. The preferred fasteners 4 are 2.5" long Simpson Strong Drive Screws.

Figure 6:
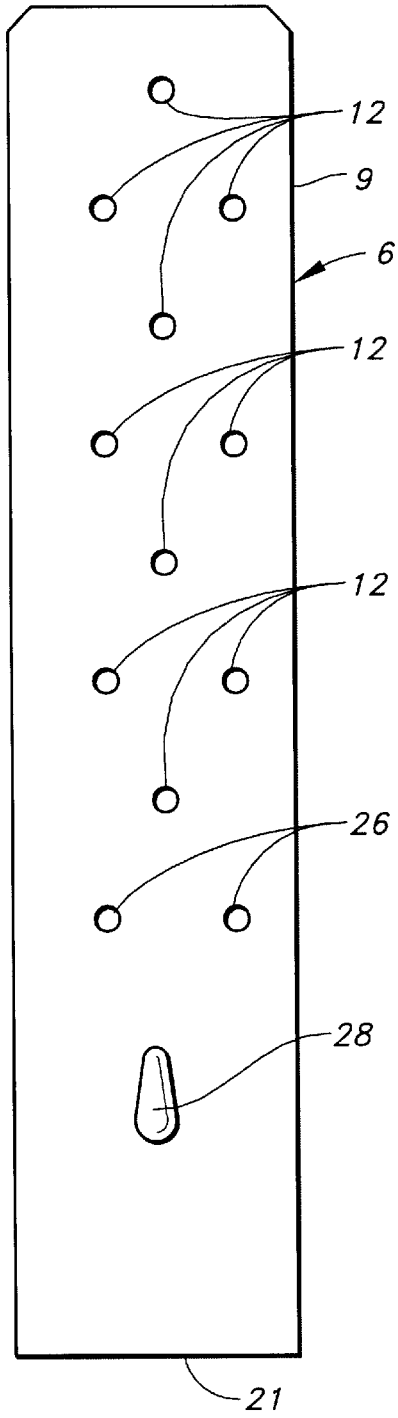
FIG. 6 is a side view of the strap of the connector of FIG. 1.
Figure 7:
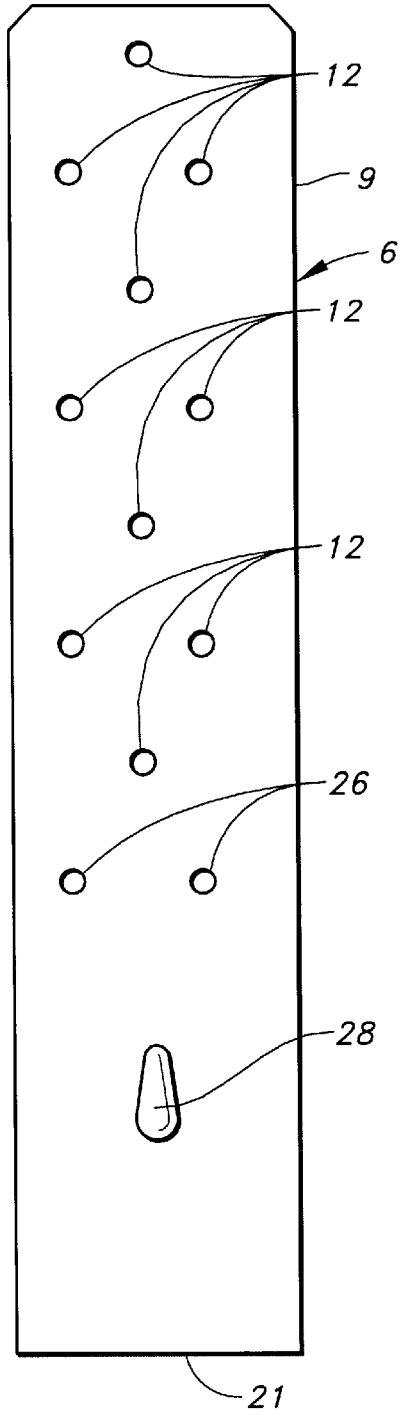
FIG. 7 is a side view of the strap of the connector of FIG. 1.

Referring to FIGS. 6 and 7, in the preferred embodiment, the lowest opening 26 for receiving a fastener 4 in the strap 6 is spaced from the top 18 of the standoff base 7 by a selected distance. This distance is dependent on the fasteners 4 used with the connector 1 and the form and composition of the first building structural member 2 to which the strap 6 connects. Splitting of wooden structural members is a problem if fasteners 4 that pierce the first building structural member 2 are placed too close to the end of the first building structural member 2.

When the first building structural member 2 is made of steel the connector 1 can be welded to the first building structural member 2, thus the back member 6 need not be formed with openings 12 and 26 and the fasteners 4 can be welds.

The strap 6 of the preferred embodiment is formed from pre-galvanized sheet metal. The preferred embodiment of the standoff base 7 if formed as a cast aluminum piece. The preferred form of the connector 1 does not need to be painted or welded. This reduces manufacturing costs.

The preferred standoff base 7 is formed with a notch 27 at each junction of the two opposed lateral sides 1 7 of the base 7 with the top 18 of the standoff base 7. These notches create locking surfaces 29 on the base 7. These notches 27 in combination with inward embossments 28 in the side members 9 of the strap 6 allow the standoff base 7 to be locked in place in the strap 6.

Figure 4:
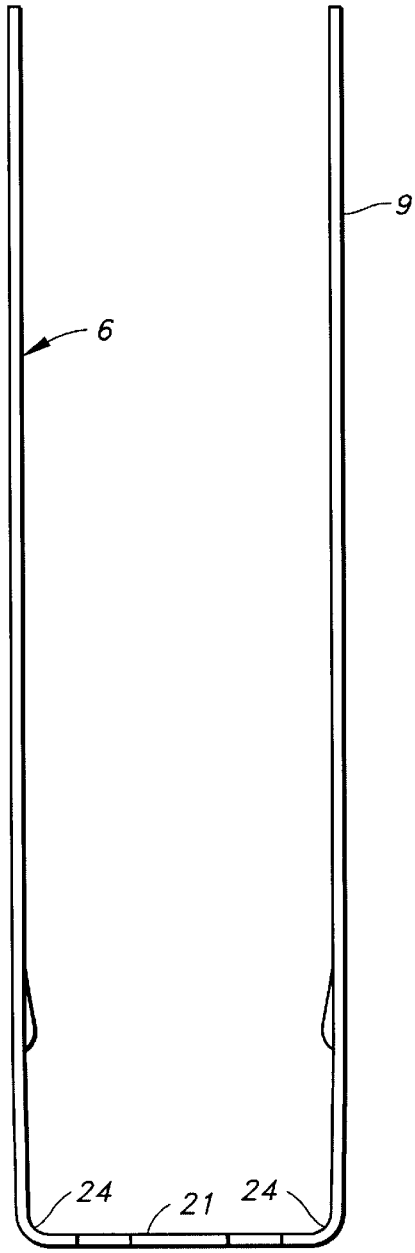
FIG. 4 is a front elevation view of the strap of the connector of FIG. 1.

The preferred embodiment is formed in the following manner. A blank, which will become the strap 6, is cut from the pre-galvanized sheet metal. The openings 10, 12 and 26 in the strap 6 are formed by cutting out portions from the blank. The blank is then formed into the generally channel shape shown in FIG. 4, by bending the first and second side members 9 up from the base 21. The standoff base 7 is cast from aluminum. The standoff base 7 is then inserted into strap 6, with the embossments 28 in the side members 9 of the strap 6 meeting with the locking surfaces 29 on the base 7, holding the standoff base 7 in place.

In the preferred form of the invention for receiving a standard 4×4 post 2, where the dimensions of the top 18 of the standoff base 7 are 3¼ inches by 3⁹⁄₁₆ inches, the bearing area of the top 18 of the standoff base 7 is roughly eight square inches. In the preferred embodiment, the bottom face of the standoff base 7 is formed to be substantially as wide as the post 2 received between the side members 9 of the strap 6. Thus, the opposing lateral sides 17 of the standoff base 7 are practically vertical. In fact, in the preferred embodiment, where the standoff base 7 is a cast member made from aluminum, the opposing lateral sides 17 taper by 1 degree to aid in their casting.

In the preferred embodiment of the standoff base 7, the opening 11 in the standoff base 7 for receiving the anchor member 5 connects with a bore in the top 18 of the standoff base 7, and the bore 30 and the opening 11 meet at a shoulder 31 in the standoff base 7. In the preferred embodiment, the distance from the shoulder 31 to the bottom face 15 of the standoff base 7 is ⅝ inches. In the preferred embodiment the bore 30 in the standoff base 7 and the shoulder 31 are formed so that a threaded nut 14 that will thread onto a bolt 13 that can be received by the opening 11 in the standoff base 7 can be received in the bore 30 and this threaded nut 14 can also reach the shoulder 31.

In the preferred embodiment, the center of the opening 11 for receiving the anchor member 5 in the standoff base 7 aligns with the central axis of the first building structural member 2 when it is received between the side members 9.

As shown best in FIG. 2, in the preferred embodiment, the strap 6 and the standoff base 7 are separate members. In the preferred embodiment, when tension forces are placed on the connector 1 the standoff base 7 resists uplift forces on the strap 6 by holding the base of the strap 6 down.

Figure 9:
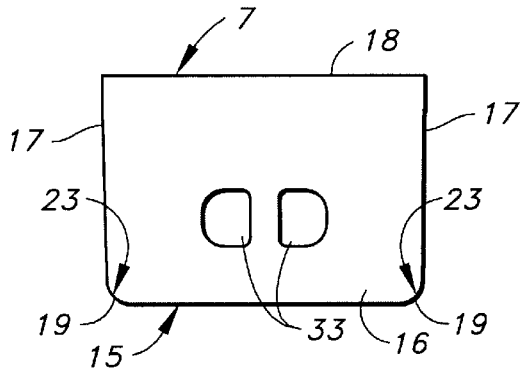
FIG. 9 is a front elevation view of the standoff base of the connector of FIG. 1.
Figure 11:
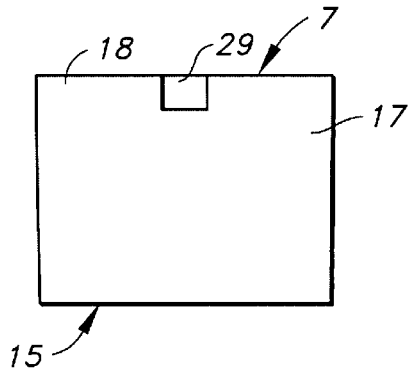
FIG. 11 is a side view of the standoff base of the connector of FIG. 1.
Figure 10:
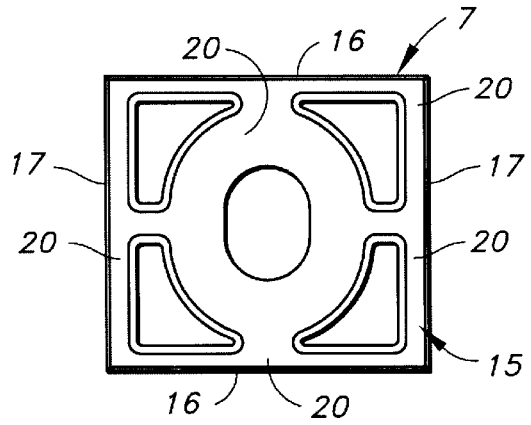
FIG. 10 is a bottom plan view of the standoff base of the connector of FIG. 1.
Figure 12:
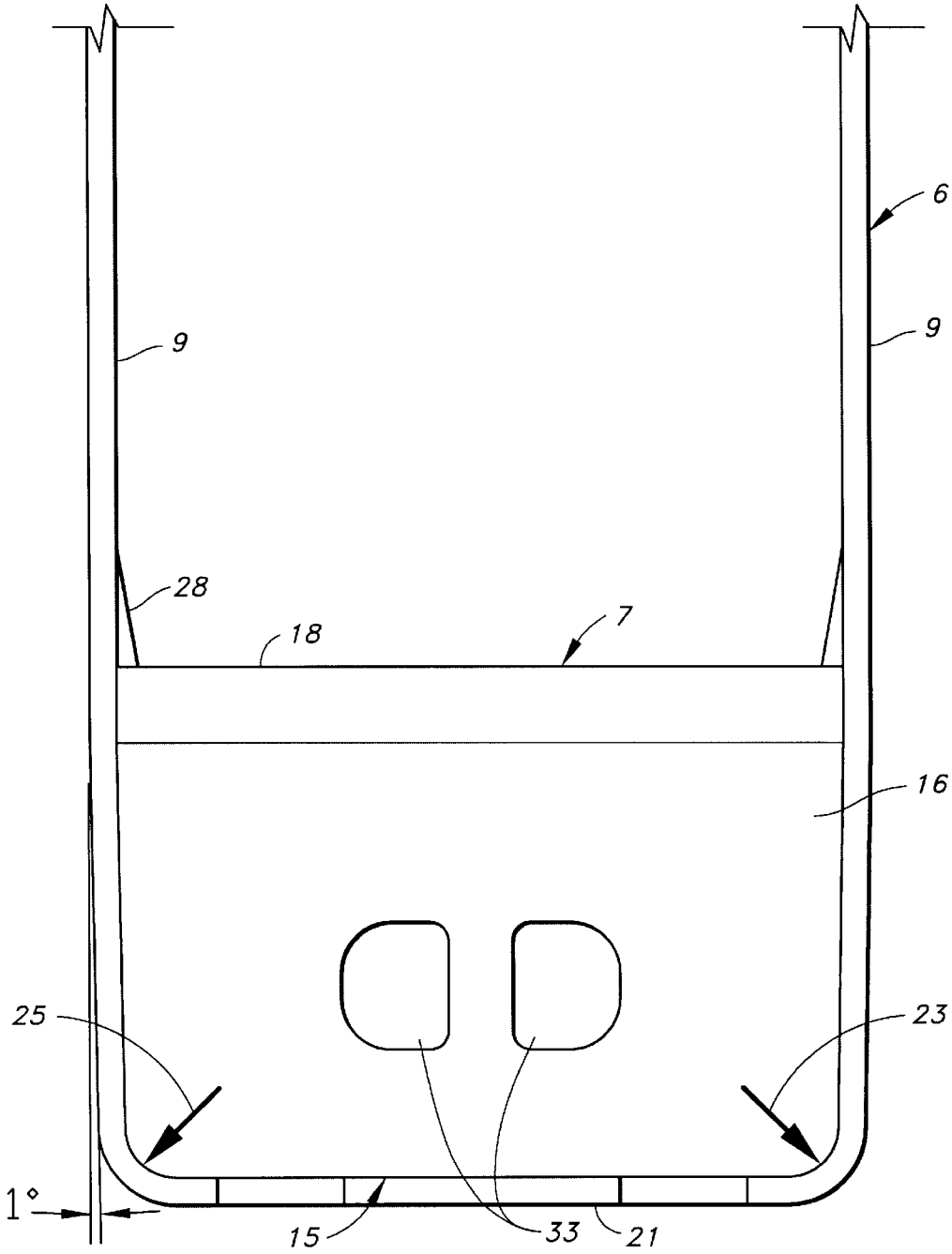
FIG. 12 is an enlarged front elevation view of the connector of the present invention showing the standoff base inserted into the strap

As is shown best in FIGS. 2, 8 and 9, the standoff base 7 is formed with windows 33 through which an inspector can view whether the anchor member 5 protrudes sufficiently into the standoff base 7 and is held on the standoff base 7 by a nut 14 or other holding member 14. These windows 33 also allow air to circulate under the bottom end of the post 2 or stud to help prevent wood rot.

The standoff base 7 is preferably made from aluminum. The grade of the aluminum is 6061, T6 or its equivalent. The strap 6 is preferably made from 10 gauge (0.130") galvanized steel which meets the following specifications: G90, A-653, SS GR 33, $F_y$=33 KSI, $F_u$=45 KSI.

As stated above, for purposes of manufacturing the preferred embodiment, the two opposed lateral side walls 17 of the cast standoff base 7 are formed with a one degree taper. The side members 9 of the strap 6 where they receive the standoff base 7 are also formed with a one degree taper to match the standoff base 7 exactly.

FIG. 1 shows a typical use of the preferred embodiment. In FIG. 1 the first building structural member 2 is a vertical stud 2 of a framed wall and the second building structural member 3 is a concrete foundation 3. The present invention may also be used to transfer tension loads between floors of a framed structure, or to tie joists to masonry or concrete walls, to name but a few applications.

Installation of the connector 1 of the preferred embodiment to form a foundation-to-wooden-stud connection is illustrated by FIG. 1.

First, an anchor bolt 13 having a threaded top portion is embedded in the second building structural member 3. This can be done by placing the bottom portion of the anchor bolt 13 in the wet concrete or by forming the second building structural member 3 with the top portion of the anchor bolt protruding from it. The latter method is preferred.

The connector 1 is then fitted over the anchor bolt 13. The threaded portion of the anchor bolt 13 is inserted into the openings 10 and 11 in the strap 6 and the standoff base 7 at the base of the connector 1, such that anchor bolt 13 protrudes above the shoulder 31 which represents the base of the larger bore 30 or opening. Preferably, and as shown in FIG. 1, the connector 1 should rest on the second building structural member 3. Preferably, the threaded portion of the anchor bolt 13 should not protrude above the top level 18 of the standoff base 7.

A washer 32 is inserted over the top portion of the anchor bolt 13 so that it rests on the shoulder 31. A nut 14 is then placed on the threaded portion of the anchor bolt 13 and tightened down so that it bears upon the washer 32, and the washer 32 bears upon the shoulder 31 of the standoff base 7. Preferably, a socket wrench is used to tighten the nut 14 on the anchor bolt 13.

The vertical framing member 2 is then inserted into the connector 1, between the side members 9 of the strap 6, so that it rests on top of the standoff base 7.

Fasteners 4 are driven into the first building structural member 2 through the openings 12 and 26 in the strap 6, forming a tight fit between the strap 6 of the connector 1 and the first building structural member 2, completing the connection.

I claim:

1. A connection between a first building structural member and a second building structural member comprising:

a. said second structural building member;

b. an anchor member, held by said second structural building member, said anchor member having a first end protruding above said second structural building member;

c. a connector receiving said first end of said anchor member, said connector comprising:

1. a channel-shaped strap having a base and two side members, said base of said strap being formed with an opening for receiving said anchor member there through for attaching said connector to said second building structural member;

2. a separate standoff base received between said side members of said strap and resting on said base of said strap, said standoff base being formed with an opening for receiving said anchor member, said standoff base being connected to said anchor member;

d. said first building structural member received between said side members of said strap and resting on and supported by said top of said standoff base while being disposed above said first end of said anchor member;

e. fasteners connecting said strap of said connector to said first building structural member;

f. said standoff base has a bottom face and two opposite lateral sides, said bottom face meeting said two opposite lateral sides at two lateral junctures, said bottom face of said standoff base being formed with a bearing surface, and said opposing lateral sides each having a selected height; and g. said base and side members of said strap are formed to conform exactly to the shape of said bearing surface and to the shape of said standoff base at said two lateral junctures.

2. The connection of claim 1, wherein:

said side members of said strap are formed to conform exactly to the shape of said opposing lateral sides of said standoff base for substantially all of said height of said opposing lateral sides.

3. The connection of claim 2, wherein:

said lateral junctures, where said bottom face meets said two opposing lateral sides, are formed with continuous curving profiles.

4. The connection of claim 3, wherein:

said bottom of said standoff base is formed to be substantially as wide as said first building structural member received between said side members of said strap.

5. The connection of claim 4, wherein:

said curved lateral junctures have radii of 0.250".

6. The connection of claim 5, wherein:

said opposing lateral sides of said standoff base have portions that taper 1 degree.

7. The connection of claim 6, wherein:

a. one or more of said side members of said strap is formed with a inwardly projecting embossment;

b. said standoff base is formed with one or more locking surfaces; and c. said inwardly projecting embossment of said side member bears upon said locking surfaces to hold said standoff base on said strap.

8. The connection of claim 7, wherein:

said standoff base is formed with one or more openings for viewing said connection of said anchor member to said standoff base.

9. The connection of claim 8, wherein:

a. said opening in said standoff base for receiving said anchor member connects with a bore in said top of said standoff base; and b. said bore and said opening meeting at a shoulder in said standoff base.

10. The connection of claim 9, wherein:

said anchor member comprises a threaded anchor bolt and a threaded nut that can be threadably received on said anchor bolt; and said bore in said standoff base and said shoulder are formed so that said threaded nut can be received in said bore and said threaded nut can reach said shoulder.

11. The connection of claim 10, wherein:

said strap is formed with openings for receiving said fasteners.

12. The connection of claim 11, wherein:

said standoff base serves as a rigid bearing member for said first building structural member.

13. The connection of claim 1, wherein:

a. said standoff base has a bottom face and two opposing lateral sides, said bottom face meeting said two opposing lateral sides at two lateral junctures; and b. said lateral junctures, where said bottom face meets said two opposing lateral sides, are formed with continuous curving profiles.

14. The connection of claim 13, wherein:

said curved lateral junctures have radii of 0.250".

15. The connection of claim 13, wherein:

said bottom of said standoff base is formed to be substantially as wide as said first building structural member received between said side members of said strap.

16. The connection of claim 15, wherein:

said opposing lateral sides of said standoff base have portions that taper 1 degree.

* * * * *

UNITED STATES PATENT AND TRADEMARK OFFICE

CERTIFICATE OF CORRECTION

PATENT NO. : 6,513,290 B2
DATED : February 4, 2003
INVENTOR(S) : William F. Leek It is certified that error appears in the above-identified patent and that said Letters Patent is hereby corrected as shown below:

Column 1,
Line 42, replace “anchor member—and attach” with -- anchor member and attach --.
Line 43, replace “building structural member generally” with
-- building structural member—generally --.

Column 5,
Line 48, replace “member 5 connects with a bore in the top 18” with
-- member 5 connects with a bore 30 in the top 18 --.

Column 6,
Line 33, replace “the top portion of the anchor bolt” with
-- the top portion of the anchor bolt 13 --.

Column 7,
Line 20, replace “bottom face and two opposite” with
-- bottom face and two opposing --.
Line 21, replace “face meeting said two opposite” with
-- face meeting said two opposing --.

Signed and Sealed this

Twenty-fifth Day of March, 2003

JAMES E. ROGAN
*Director of the United States Patent and Trademark Office*